US011067236B2

(12) United States Patent
Bembridge et al.

(10) Patent No.: US 11,067,236 B2
(45) Date of Patent: Jul. 20, 2021

(54) ELONGATED STRUCTURE

(71) Applicant: SIGNIFY HOLDING B.V., Eindhoven (NL)

(72) Inventors: Mathew Lee Bembridge, Eindhoven (NL); Winand Hendrik Anna Maria Friederichs, Eindhoven (NL); Petra Bijl, Eindhoven (NL); Ay Ling De Goederen-Oei, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 112 days.

(21) Appl. No.: 16/471,332

(22) PCT Filed: Dec. 13, 2017

(86) PCT No.: PCT/EP2017/082523
§ 371 (c)(1),
(2) Date: Jun. 19, 2019

(87) PCT Pub. No.: WO2018/114495
PCT Pub. Date: Jun. 28, 2018

(65) Prior Publication Data

US 2020/0116318 A1 Apr. 16, 2020

(30) Foreign Application Priority Data

Dec. 22, 2016 (EP) ..... 16206374
Jan. 26, 2017 (EP) ..... 17153258

(51) Int. Cl.
*F21S 8/08* (2006.01)
*F21V 21/10* (2006.01)
(Continued)

(52) U.S. Cl.
CPC ..... *F21S 8/085* (2013.01); *E04H 12/003* (2013.01); *E04H 12/08* (2013.01); *F21V 21/10* (2013.01);
(Continued)

(58) Field of Classification Search
CPC ..... E04H 12/003; E04H 12/08; E04H 12/085; F21S 8/085; F21V 7/0008; F21V 21/10;
(Continued)

(56) References Cited

U.S. PATENT DOCUMENTS 1,643,955 A * 10/1927 Rank ..... E01F 9/629 40/608
2,808,135 A * 10/1957 Moran ..... E04H 12/08 138/157
(Continued)

FOREIGN PATENT DOCUMENTS

CN 104806045 A 7/2015
JP 2001-065201 A 3/2001
(Continued)

*Primary Examiner* — James M Ference

(57) ABSTRACT

The invention provides an elongated structure comprising a pole having a wall around a hollow core as a tubular body part extending along a length axis. A base section of the wall of the tubular body part is connected to an H-shaped frame extending from a foot of the pole along the length axis, said H-shaped frame being arranged in the core. The wall at the location of the H-shaped frame is provided with a door, said door in closed position being flush with the wall and in opened position providing access to the core.

15 Claims, 5 Drawing Sheets

(51) Int. Cl.

| | |
|---|---|
| ***E04H 12/08*** | (2006.01) |
| ***E04H 12/00*** | (2006.01) |
| *F21V 25/00* | (2006.01) |
| *F21W 111/02* | (2006.01) |
| *F21W 131/103* | (2006.01) |
| *F21V 7/00* | (2006.01) |

(52) U.S. Cl.
CPC ..... *E04H 12/085* (2013.01); *F21V 7/0008* (2013.01); *F21V 25/00* (2013.01); *F21W 2111/02* (2013.01); *F21W 2131/103* (2013.01)

(58) Field of Classification Search
CPC ..... F21V 25/00; F21W 2111/02; F21W 2131/103; G08G 1/095
See application file for complete search history.

(56) References Cited

U.S. PATENT DOCUMENTS 3,373,276 A * 3/1968 Klein ..... H02B 1/50 174/45 R
3,375,620 A * 4/1968 Phillips ..... F21V 21/10 52/28
3,714,369 A * 1/1973 Bunten ..... H02B 1/50 174/38
3,928,712 A * 12/1975 Sears ..... A41G 1/001 174/38
4,211,179 A * 7/1980 Saunders ..... B29C 45/14467 114/90
4,435,027 A * 3/1984 Prather ..... E05B 65/0003 174/38
4,519,657 A * 5/1985 Jensen ..... H02B 1/50 174/38
4,606,167 A * 8/1986 Thorne ..... E04B 1/944 52/364
4,631,353 A * 12/1986 Marks ..... H02G 9/10 174/16.1
4,823,533 A * 4/1989 Hillstrom ..... E04F 13/0803 52/510
4,961,258 A * 10/1990 Menzel ..... B44C 3/12 156/264
5,210,374 A * 5/1993 Channell ..... G02B 6/4444 174/38
5,611,616 A * 3/1997 Chandler ..... H02B 1/50 116/202
5,860,715 A * 1/1999 Lohde ..... H02B 1/50 312/287
5,881,528 A * 3/1999 Grewe ..... E04C 3/30 52/831
6,009,683 A * 1/2000 Grewe ..... E04C 3/30 52/301
6,148,585 A * 11/2000 Baker ..... E04C 3/30 52/36.6
6,222,503 B1 * 4/2001 Gietema ..... H01Q 1/1207 343/700 MS
6,912,408 B1 * 6/2005 O'Neill ..... H01Q 1/12 343/890
7,351,909 B1 * 4/2008 Harwood ..... H02G 3/0493 174/37
7,779,588 B1 * 8/2010 Bruning ..... E02D 27/42 52/297
7,874,126 B2 * 1/2011 Fournier ..... H02G 9/10 52/843
8,013,569 B2 * 9/2011 Hartman ..... B60L 53/53 320/109
9,395,042 B2 * 7/2016 Harris ..... A47F 5/105
9,523,188 B2 * 12/2016 Rahimzadeh ..... E04C 3/293
9,941,736 B1 * 4/2018 Ellingboe ..... H01R 13/5213
2002/0171074 A1 * 11/2002 Imai ..... E01F 9/623 256/13.1
2005/0166521 A1 * 8/2005 Silber ..... E04H 12/10 52/633
2007/0284370 A1 * 12/2007 Dively ..... H02G 3/0493 220/3.8
2008/0149786 A1 * 6/2008 Bradley ..... E04H 17/20 248/121
2008/0149791 A1 * 6/2008 Bradley ..... E04H 12/2269 248/220.21
2008/0253061 A1 * 10/2008 Seff ..... H02B 1/50 361/622
2008/0253062 A1 * 10/2008 Seff ..... H02B 1/50 361/622
2009/0040750 A1 * 2/2009 Myer ..... F21S 9/037 362/183
2010/0050568 A1 * 3/2010 Griffiths ..... E04F 13/0733 52/834
2010/0051310 A1 * 3/2010 Wurzer ..... H02G 3/0493 174/59
2010/0052549 A1 * 3/2010 Hudson ..... E01F 9/617 315/156
2010/0146901 A1 * 6/2010 Griffiths ..... F16B 35/041 52/651.11
2010/0296230 A1 * 11/2010 Storck ..... B60L 53/16 361/641
2011/0290305 A1 * 12/2011 Hoffmann ..... F24S 25/50 136/251
2012/0131866 A1 * 5/2012 Batut ..... F24S 25/13 52/173.3
2012/0174522 A1 * 7/2012 Gregor ..... F03D 13/10 52/651.01
2012/0181973 A1 * 7/2012 Lyden ..... B60L 8/003 320/101
2012/0307069 A1 * 12/2012 Pierce ..... H04N 5/23206 348/159
2013/0229141 A1 * 9/2013 Johnson ..... B60L 53/31 320/101
2017/0234024 A1 * 8/2017 Hardie ..... F21V 21/10 362/431
2020/0116318 A1 * 4/2020 Bembridge ..... E04H 12/003

FOREIGN PATENT DOCUMENTS

| | | | |
|---|---|---|---|
| JP | 2001-303715 | A | 10/2001 |
| JP | 2004-092254 | A | 3/2004 |
| JP | 3106448 | U | 1/2005 |
| JP | 3166638 | U | 3/2011 |
| JP | 2013-504699 | A | 2/2013 |
| JP | 2015-017447 | A | 1/2015 |
| JP | 2016-153580 | A | 8/2016 |
| KR | 20110082377 | A | 7/2011 |
| WO | 2011029515 | A2 | 3/2011 |

* cited by examiner

ELONGATED STRUCTURE

CROSS-REFERENCE TO PRIOR APPLICATIONS

This application is the U.S. National Phase application under 35 U.S.C. § 371 of International Application No. PCT/EP2017/082523, filed on Dec. 13, 2017, which claims the benefits of European Patent Application No. 17153258.3, filed on Jan. 26, 2017 and European Patent Application No. 16206374.7, filed on Dec. 22, 2016. These applications are hereby incorporated by reference herein.

FIELD OF THE INVENTION

The invention relates to an elongated structure having a length axis and comprising a pole comprising a wall around a hollow core as a tubular body part extending along the length axis. The invention further relates to a street pole and a street light pole.

BACKGROUND OF THE INVENTION

Such an elongated structure is known from U.S. Pat. No. 6,222,503B1. Said known structure is a street light pole, also referred to as street luminaire, comprising a rectangular, box-shaped pedestal as a base section upon which a shaft is mounted with a lamp housing at its end. The closed, box-shaped pedestal has to simultaneously fulfill two functions, i.e. to support the shaft with mounted lamp housing and to safely accommodate electronics equipment, for example a frequency converter, power supplies, battery backups, and control circuits etc. Due to the requirement to fulfill the two functions simultaneously, the known elongated structure has the disadvantages of having a relatively spacious and bulky pedestal compared to the dimensions of the shaft. This renders the known elongated structure to have the further disadvantages of being unattractive because its pedestal is prominent visible and the pedestal requires relatively a lot of material involving a relatively high bill of material.

SUMMARY OF THE INVENTION

It is an object of the invention to counteract at least one of the disadvantages of the known elongated structure. Thereto, the invention provides an elongated structure of the type as described in the opening paragraph having the features of an elongated structure having a length axis and comprising:

a pole comprising a circular wall around a hollow core as a tubular body part extending in an axial direction along the length axis;

an H-shaped frame arranged in the core and extending in the axial direction and being connected to the wall at at least a base section of the tubular body part, wherein the H-shaped frame is formed by stems connected by a cross-bar wherein ends of said stems are touched by the circular wall circumscribing the H-shaped frame thereby essentially dividing the core in at least two concave portions, at least two doors provided in the wall and arranged on either side of the H-shaped frame, a respective concave portion being formed by the cross bar, respective stem parts, and a respective wall part, with a respective door in opened position providing access to said respective concave portion and in closed position closing said respective concave portion, and wherein equipment is concealable in the base section of the tubular body and mountable in the concave portions of the H-shaped frame by mounting onto mounting means provided at the H-shaped frame.

a pole comprising a circular wall around a hollow core as a tubular body part extending in an axial direction along the length axis;

an H-shaped frame arranged in the core and extending in the axial direction and being connected to the wall at at least a base section of the tubular body part, wherein the H-shaped frame is formed by stems connected by a cross-bar wherein ends of said stems are touched by the circular wall circumscribing the H-shaped frame thereby essentially dividing the core in at least two concave portions, at least two doors provided in the wall and arranged on either side of the H-shaped frame, a respective concave portion being formed by the cross bar, respective stem parts, and a respective wall part, with a respective door in opened position providing access to said respective concave portion and in closed position closing said respective concave portion, and wherein equipment is concealable in the base section of the tubular body and mountable in the concave portions of the H-shaped frame by mounting onto mounting means provided at the H-shaped frame. Preferably said at least one door in closed position is flush with the wall.

The description of the H-shaped frame is done by using typeface anatomy expressions. The cross-sectional H-shape of the frame might have the feature that and could be described as a shaped frame having in cross section a H-shaped profile having two essentially equal, parallel or slightly curved stems (also referred to as bars) having a length Lp and being mutually connected at a location in a range of 0.4*Lp to 0.6*Lp, preferably halfway at 0.5*Lp, by a cross-bar (also referred to as transverse bar) having a length Lt, wherein an aspect ratio of Lp to Lt preferably is in the range of 0.2 to 5, preferably 0.5 to 2, more preferably 0.8 to 1.25. Said aspect ratio in the range of 0.2 to 5 renders the H-frame shape to be strong enough in transverse directions, with aspect ratios of 0.5 to 2 and 0.8 to 1.25 the strength in transverse directions is further increased, and said aspect ratios renders the concave portions to be better dimensioned for accommodating electronic equipment. The equal bars could be slightly curved towards each other, for example adapted to the curvature of the outer wall of the tubular body part in which said H-shaped frame is arranged. The H-shape could equally be described as an I-shape.

The safe accommodation of equipment could be done in the hollow core of only a tubular body without any internal structure, however, said equipment is then either mounted onto the wall of the tubular body part, resulting in difficult access to said equipment. Furthermore, doors in the tubular body for access to the concealed equipment therein, results in loss of strength of the elongated structure. Alternatively, said equipment is not mounted onto said wall and placed somehow loose in the hollow core, making a stacked arrangement of equipment difficult and resulting in a bulky box-shaped pedestal. The safe accommodation and robustness of the closed pedestal of the known elongated structure is attained by providing the box shape with thick ribs and faces.

In the elongated structure according to the invention, this robustness for supporting and/or bearing the weight of the pole, is typically obtained by the H-shape, while concave portions of the H-shaped frame, as formed by the portions of the parallel bars and the transverse bar, are especially suitable for safely accommodating electronic equipment. By said wall around the hollow core in which the H-shaped frame is arranged, the elongated structure has a tubular appearance and shields electronic equipment accommodated in the said hollow core from being visible. If the electronic equipment is arranged in a stacked arrangement along the length axis in said concave portions, the radial dimensions or the tubular body part at the base section of the elongated structure that are required for accommodating the electronic equipment can be relatively small. This enables the base section to have the same dimensions or only slightly larger dimensions in radial direction than the dimensions in radial direction of extension sections and top section of the tubular shaped elongated structure rendering the base section to be relatively unobtrusive and more attractive than the known elongated structure. Furthermore, the at least one door in the base section could be provided in the wall, or the at least one door could be embodied as the complete wall of the base section. Said door gives easy access to the hollow core and enables simple connection onto existing cabling networks of cabling provided inside the elongated structure. Said cabling could be electric cabling for example for providing electrical power or Ethernet and/or could be glass fibers for example for providing Ethernet. To counteract vandalism, said door preferably is as unobtrusive as possible and therefore in closed position preferably is flush with the outer surface of the wall of the tubular body part. Preferably, two doors are provided in the base section, said two doors preferably being mutually oppositely arranged at the concave portions and on either side of the H-shaped frame enabling easy access to the hollow core and equipment concealed therein from both opposite sides. Though other frame shapes than a H-shape are possible, for example a T-shape, a Y-shape or a U-shape, it appears that in particular the H-shape offers a relatively good profile for fulfilling the strength requirement, the possibility of accommodating equipment, and ease of access to equipment. Yet said T-shape, Y-shape and U-shape could be part of the invention. Usually, but not necessarily, the H-shaped frame extends at least over a major part of the base section, for example from a foot of the pole to an extension section.

The elongated structure having the feature that the tubular wall is circular and wherein the H-shaped frame comprises parallel vertical bars and is dimensioned such that ends of said vertical bars touch the circular wall circumscribing the H-shaped frame and are supported thereby. If the outer wall is completely formed by the doors, the outer wall is supported both by the hinges via which the doors are hinged to the H-shaped frame and said ends of said vertical bars of the circumscribing the H-shaped frame. This enhances the robustness and strength of the wall against vandalism or, for example, bike parking. It is noted that the doors itself do not bear the elongated structure, this is done by the H-shaped frame.

Typically, the elongated structure is used as a street pole and/or a street light pole (or street luminaire) comprising a lamp housing for accommodating a lamp or light source mounted at an end section of the elongated structure. Typically, in these embodiments of the elongated structure, the axial direction corresponds with the vertical direction, i.e. the direction of gravity. Some street poles and street light pole in public spaces comprise concealed electronic apparatuses within the base section of their structure for ease of maintenance and servicing, like electric cabling, converters, drivers, a radio, battery back-ups, filters, and an antenna. Some of these apparatuses are heat sensitive, like electronic drivers, and some generate heat, for example radios. When arranged in a vertically stacked arrangement it is therefore preferred that the heat sensitive apparatuses are positioned remote and/or below the heat generating radio, especially because of the chimney effect in a hollow core of the tubular body. For example, a stacked arrangement of the apparatuses in the base section could be as follows, a driver at the very bottom, a radio above the driver, with preferably a heat shielding plate in between the driver and the radio, then on top of the radio some filters. The heat shielding plate should be arranged in a transverse orientation with respect to the length axis thus sub-dividing the hollow core into at least two compartments. Said heat shield can, for example, be made of foam, for example foam of a high temperature resistant synthetic polymer. Said transverse heat shield plate being provided with an opening to enable a chimney effect while the opening being designed, for example in that the opening has flare as its perimeter that extends upwardly away from the radio, and the opening should be located such that backflow through said opening is counteracted to avoid undesired heat flow towards the driver. An antenna should be placed in the top section or in an extension section adjacent to the top section enabling it to adequately receive signals. Hence, the elongated structure might comprise equipment that is concealed in the base section of the tubular body and mounted onto concave portions of the H-shaped frame, preferably said equipment is arranged in a stacked arrangement along the length axis, more preferably with heat generating equipment being on top and being spaced from heat sensitive equipment. Typically, the cross bar and/or stems of H-shaped frame therefore comprise as mounting means at least one of a slot, a threaded end, a transverse plate, a threaded opening, a hook, and a rib.

The elongated structure might have the feature the base section of the wall is releasably connected to H-shaped frame, thus enabling relatively easy exchange of the wall of the tubular body part of the base section, for example in case said wall is damaged, corroded or unsuitably dimensioned. The expression releasably connected means for the whole application that a part can be removed and remounted without tools or by using simple tooling without the need for breakage or fracture of the connection between the connected parts, i.e. typically not referring to connected parts made in one piece.

The elongated structure might have the feature that an outer surface of the wall of the base section is flush with an outer surface of an adjacent wall of an extension section of the tubular body part. This renders the base section to be even more unobtrusive, rendering the elongated structure to be less vulnerable to vandalism and to look more attractive.

The elongated structure might have the feature that the wall is provided with at least one first vent opening and at least one second vent opening in axial direction on either side of the door. Due to the mutual positions of the first and second vent opening a chimney effect is obtained due to natural convection, this chimney effect enhances cooling and heat dissipation of heat generating equipment. Preferably the first vent opening is provided at the foot of the elongated structure to counteract vandalism by being as unobtrusive as possible. To further enhance the chimney effect (and thus cooling effect), the elongated structure might be provided with an electrically motorized ventilator forcing a cooling fluid, for example air, to flow from the first vent opening to the second vent opening and to counteract backflow.

The elongated structure might have the feature that the base section has a maximal diameter Db and further sections have a maximal diameter Dp, wherein $Dp <= Db <= 1.3*Dp$. This renders the advantage that the elongated structure to not stand out from other elongated structures, i.e. from street poles and street light poles in its (direct) environment, and thus not to form a point of interest to vandalism. Furthermore, thus the advantage of a more attractive look of the elongated structure is obtained. These advantages are increased if the elongated structure decreases in diameter from the base section in axial direction, and even further increased when the elongated structure continuously decreases in diameter from the base section in axial direction.

Typically, the elongated structure according to the invention can be considered as a modular structure comprising a base section, one or more extension sections and a top section, optionally provided with a lamp housing and/or a separate foot.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION OF THE EMBODIMENTS

Figure 1:
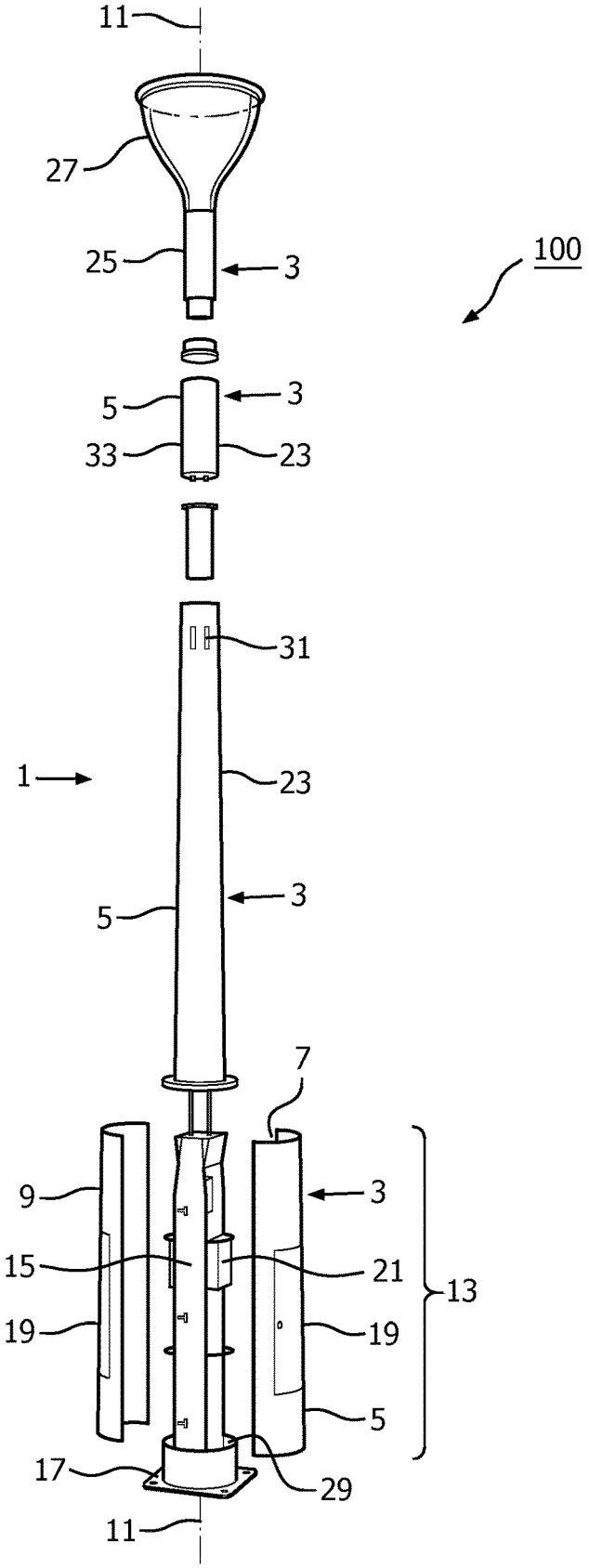
FIG. 1 shows a schematic overview of an elongated structure according to the invention embodied as a street light pole.

FIG. 1 schematically depicts an elongated structure 1 comprising a pole 3 having at least a wall 5 around a hollow core 7 as a tubular body part 9 extending along a length axis 11 in axial direction, in this case in the vertical direction of gravity. A base section 13 of the wall of the tubular body part being connected to an H-shaped frame 15 extending from a foot 17 of the pole along the length axis to an extension section 23, said H-shaped frame being arranged in the core. The wall at the location of the H-shaped frame being provided with two doors 19, the door in opened position providing access to electronic equipment 21 mounted onto the H-shaped frame in the core. The door in closed position completes closure of the hollow core, said door in closed position being flush with the wall. In the figure the doors are embodied as complete, round semi-cylinders, but could alternatively be any part of a cylindrical shape, for example it could encompass several faces of a polygonal, cylindrical shape, for example three faces of a hexagonally shaped cylinder or four faces of an irregular octagonally shaped cylinder. The elongated structure is embodied as a modular street light pole 100, and further comprises the extension section 23 and a top section 25 on which a lamp housing 27 is mounted. A first vent opening 29 is present at the foot of the street light pole and a second vent opening 31 is provided in the extension section 23 just below an antenna 33 which is mounted in a further extension section 23 adjacent the top section of the street light pole.

Figure 2:
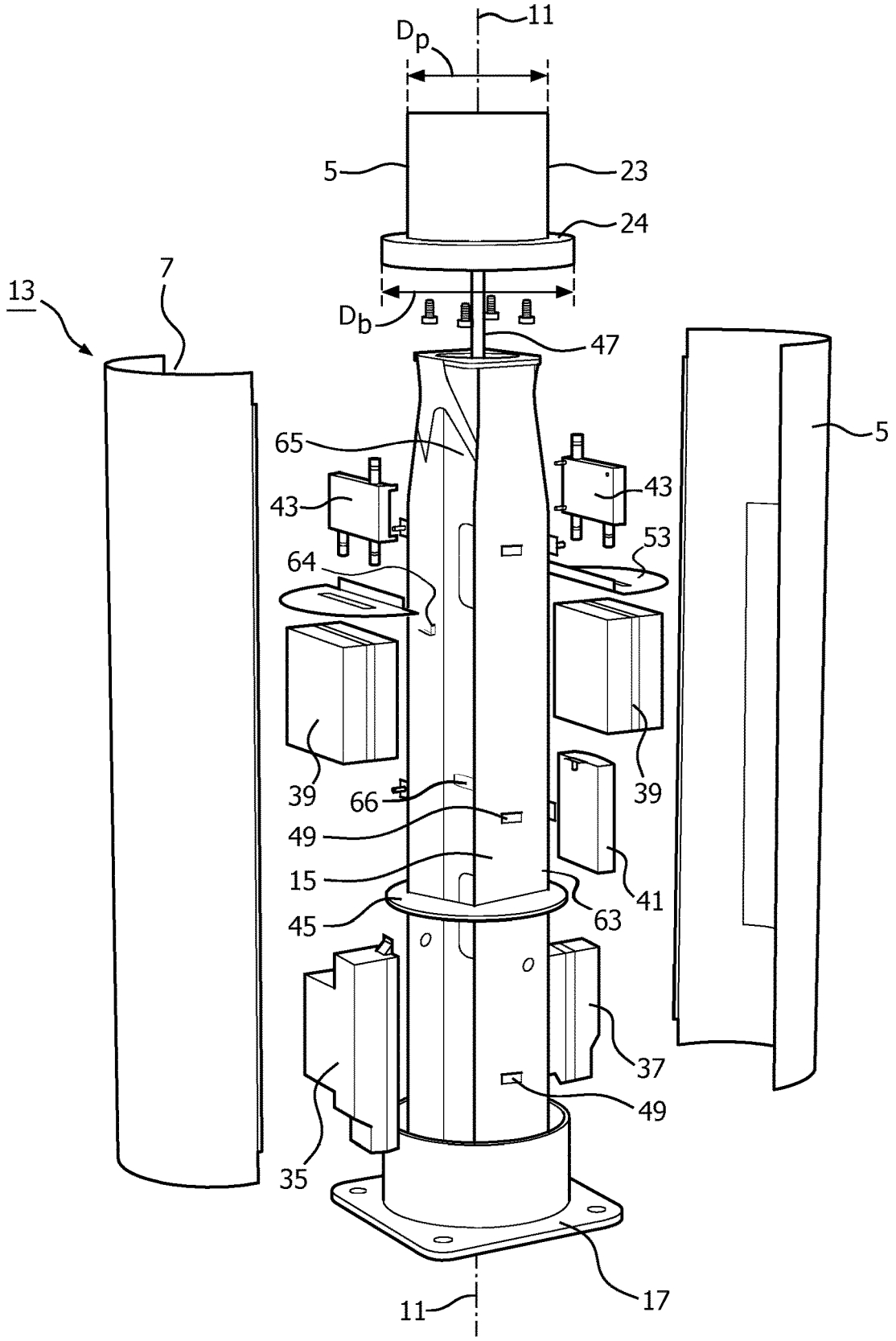
FIG. 2 shows a schematic, exploded view of a base section of the street light pole of FIG. 1.

In FIG. 2 a more detailed, exploded schematic depiction of the base section 13 of the street light pole of FIG. 1 is given. It is shown that only the base section has the H-shaped profile 15, having stems 63 and a cross-bar 65, in its hollow core 7 and that the extension section 23 is mounted with a flanged portion 24 on top of the H-shaped profile, said extension section being embodied as a hollow tube with its wall 5 forming the rigid and robust structure. Mounted in a stacked configuration along the length axis 11 and on either side to the H-shaped profile are a converter 35, a driver 37, a radio 39, an electrically motorized ventilator 41 and a filter 43. It is noted that this is just an example, not all equipment shown need to be present, in general a specific selection of these will do, depending on the desired use of the elongated structure. The radio being mounted above the driver and separated therefrom by a transversely mounted heat shield 45, said heat shield has an opening (not visible) to enable convection air flow. Electric cabling 47 or glass fibers enters the street light pole at the foot 17 and extends from the base section through the hollow core and heat shield into the extension section and is connected with an antenna and electrical contacts in the lamp housing. The base section has a diameter Db of about 33 cm which is of the same diameter of the flange portion 24 and which is about 1.3 times a maximum diameter Dp of about 26 cm of the further sections, in the figure Dp is shown for the extension section. The wall at the base section is divided in wall parts 51 which are releasably connected to the H-shaped frame via click connectors 49. Furthermore, a second transverse plate 53 is provided in two parts, which can be used as mounting means for mounting equipment, but which is separating the ventilator and radio from the filter and further subdividing the hollow core into compartments. Furthermore, the H-shaped frame is provided with additional mounting means, i.e. a hook 64 on a stem 63 and a slot 66 on the cross-bar 65.

Figure 3:
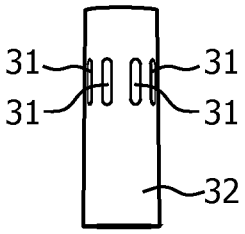
FIG. 3 shows a portion of an extension section of the street light pole of FIG. 1.

FIG. 3 shows a portion of a hollow, tubular extension section 23 of the street light pole of FIG. 1 in more detail. The extension section has second vent openings 31 evenly distributed over the annular perimeter of the wall of the extension section.

Figure 4:
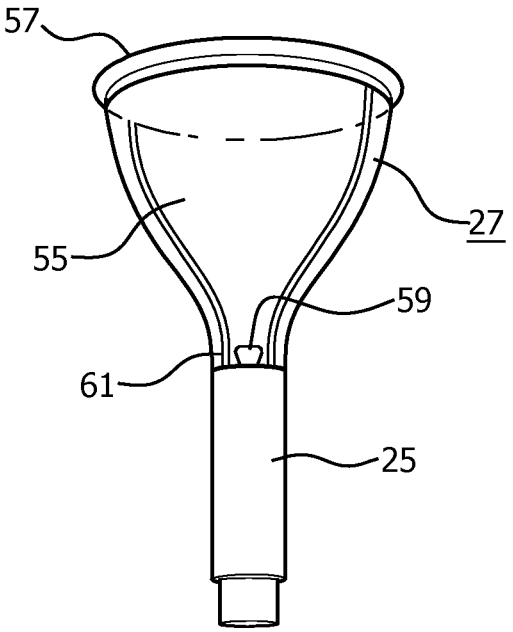
FIG. 4 shows a lamp housing of the street light pole of FIG. 1.
Figure 5A:
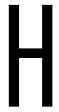
FIGS. 5*a-d* shows cross-sections of some suitable H-shaped frames.
Figure 5B:
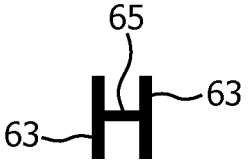
Figure 5C:
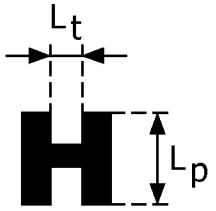
Figure 5D:
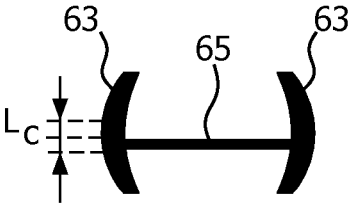

FIG. 4 shows a lamp housing 27 of the street light pole of FIG. 1 in more detail. The lamp housing is mounted on the top section 25 of the elongated structure, and comprises a light transmissive light exit window 55 and a light reflective top cover 57 which during operation of the light source reflects light originating from the light source 59 mounted at the lamp base 61 of the housing and thus provides indirect light to the ambient.

FIG. 5*a-d* shows cross-sections of some suitable H-shaped frames. All the H-shaped frame have in cross section a profile of two essentially equal, slightly curved (FIG. 5*d*) or parallel stems or bars 63 (FIG. 5*a-c*) having a length Lp and being mutually connected in a range Lc at location in between 0.4*Lp to 0.6*Lp, preferably halfway at 0.5*Lp. A cross-bar or transverse bar 65 having a length Lt, wherein a ratio of Lp to Lt is in the range of 0.2 to 5, preferably 0.5 to 2, more preferably 0.8 to 1.25.

Figure 6:
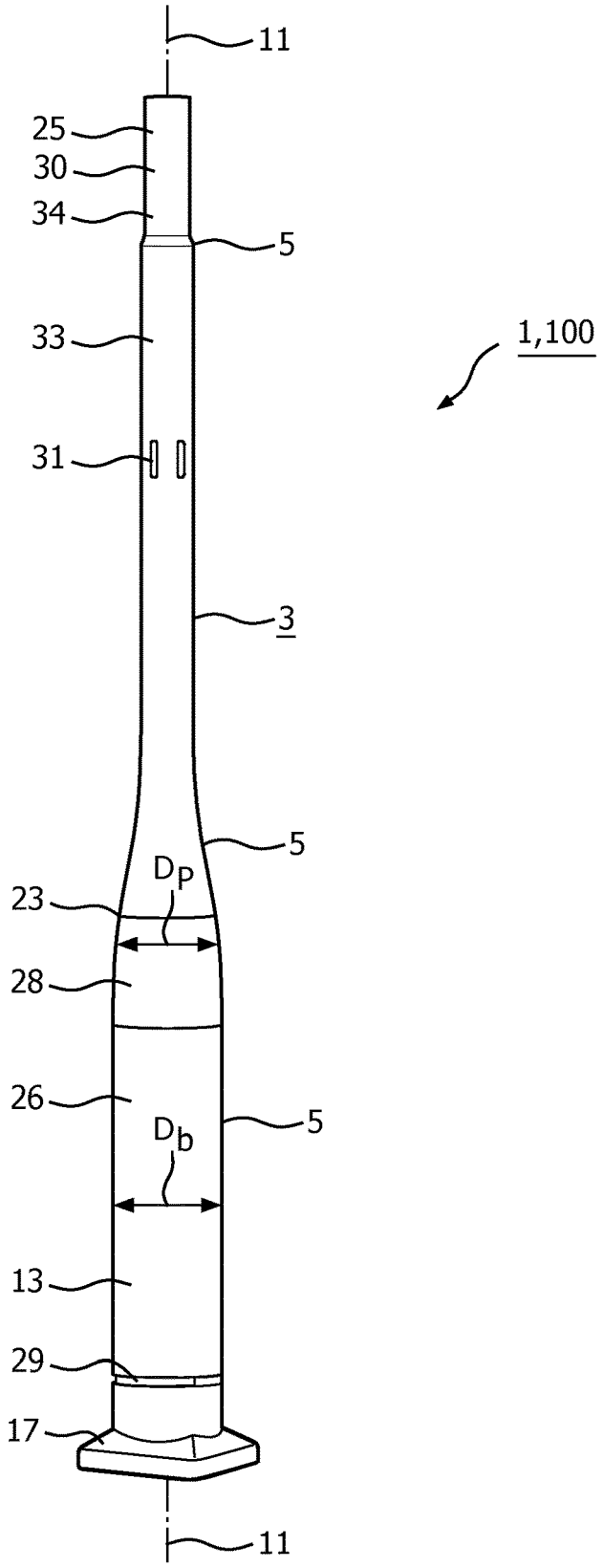
FIG. 6 shows a schematic overview of an elongated structure according to a second embodiment.

FIG. 6 shows a schematic overview of an erected, elongated structure 1 according to a second embodiment comprising a pole 3 having at least a wall 5 around a hollow core as a tubular body part 9 extending along a length axis 11. A base section 13 of the wall of the tubular body part being connected to a foot 17 of the pole and to an extension section 23 along the length axis. As shown, in the elongated structure the diameter Db from the base section continuously decreases in axial direction to the diameter Dp of the extension section and an outer surface 26 of the wall of the base section is flush with an outer surface 28 of an adjacent wall of the extension section of the tubular body part. The outer surface of extension section on its turn is flush with the outer surface 30 of a top section 25. As shown, the diameter of the elongated structure smoothly, gradually decreases from the base section to the top section. The elongated structure is embodied as a modular street pole 100, and further comprises the extension section 23 and the top section 25 in which an antenna 33 and a GPS module 34 are provided. A first vent opening 29 is present near the foot of the street pole and a second vent opening 31 is provided in the extension section 23 just below the antenna.

Figure 7:
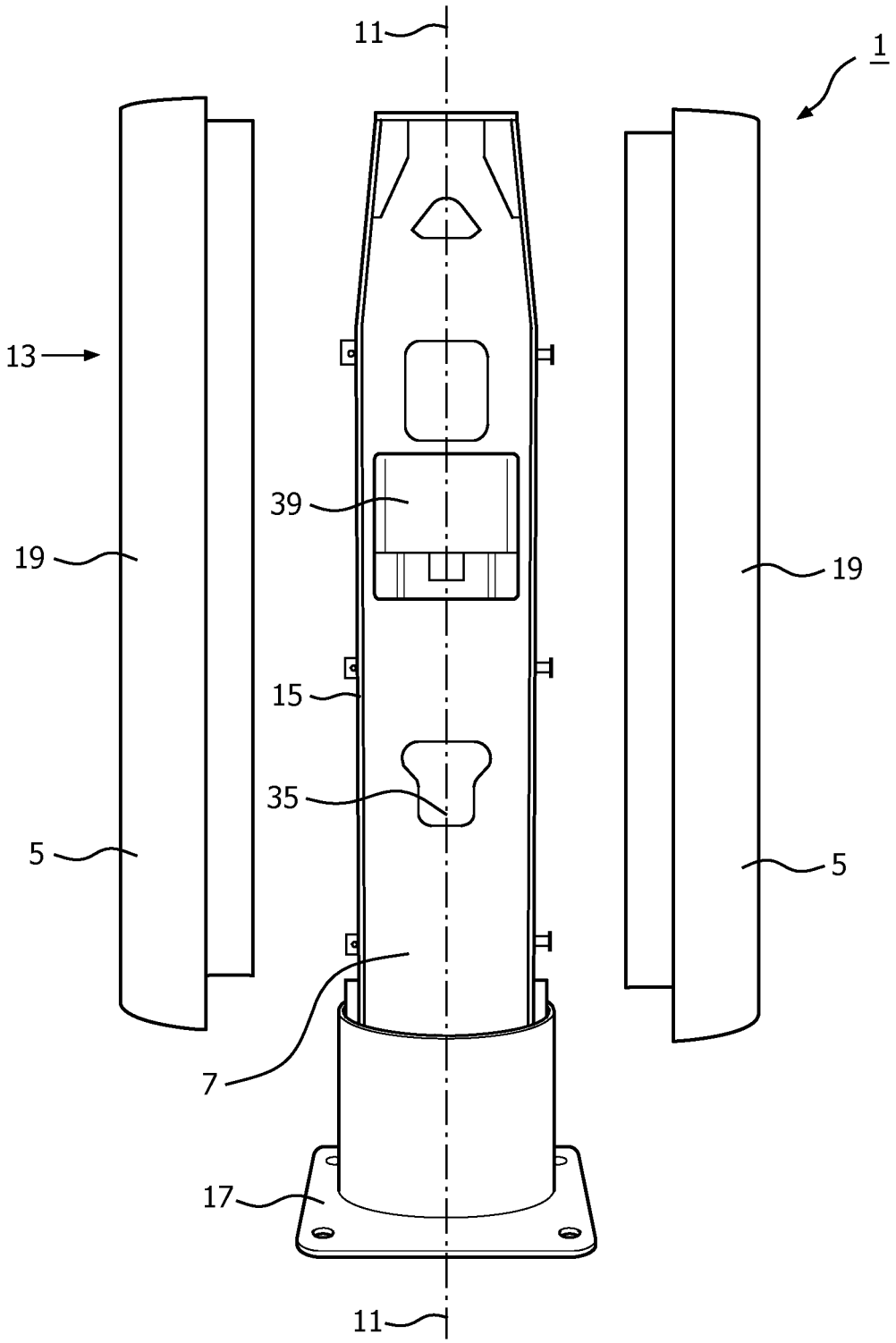
FIG. 7 shows a schematic view of third embodiment of a base section of an elongated structure according to the invention.

FIG. 7 shows a schematic view of third embodiment of a base section 13 of an elongated structure 1 according to the invention with doors 19 in open position. The base section has an outer wall 5 which in the base section are practically completely formed by the doors. The doors are in hinged connection to an axially extending H-shaped frame 15 along a longitudinal axis 11 in a cavity or hollow core 7 in the base section (formed when the doors are in closed position) and lie flush with the wall at a foot 17 of the elongated structure. Mounted on the H-shaped frame is a radio 39 which is connected to a converter 35 mounted at an opposite side of the H-shaped frame and in a lower position than the radio.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to". The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

The invention claimed is:

1. An elongated structure having a length axis and comprising:

a pole comprising a circular wall around a hollow core that define a tubular body part extending in an axial direction along the length axis;

an H-shaped frame arranged in the hollow core and extending in the axial direction and being connected to the circular wall at at least a base section of the tubular body part, wherein the H-shaped frame comprises a cross-bar and stems connected by the cross-bar, wherein ends of said stems are in direct contact with the circular wall circumscribing the H-shaped frame thereby dividing the hollow core into at least two concave portions, wherein at least two doors are provided in the circular wall and arranged on opposite sides of the H-shaped frame, wherein a respective concave portion of the at least two concave portions is formed by the cross bar, respective portions of the stems, and a respective of the circular wall, wherein a respective door of the at least two doors, when in an opened position, provides an access to said respective concave portion of the at least two concave portions and, when in a closed position, closes said respective concave portion of the at least two concave portions, and wherein electronic equipment is concealable in the base section of the tubular body part and mountable to the H-shaped frame in the at least two concave portions.

2. The elongated structure as claimed in claim 1, wherein said electronic equipment is mountable in a stacked arrangement along the length axis.

3. The elongated structure as claimed in claim 1, wherein the circular wall at the base section of the tubular body part is releasably connected to the H-shaped frame.

4. The elongated structure as claimed in claim 1, wherein said doors in the closed position are flush with the circular wall and are in a hinged connection to the circular wall.

5. The elongated structure as claimed in claim 1, wherein an outer surface of the circular wall at the base section of the tubular body part is flush with an outer surface of an adjacent wall of an extension section of the tubular body part.

6. The elongated structure as claimed in claim 1, wherein all each of the stems of the H-shaped frame touch the circular wall.

7. The elongated structure as claimed in claim 1, wherein the H-shaped frame has in cross section a profile of two of the stems that are identical, curved or parallel, and have a length Lp and are mutually connected at a location in $0.5 \pm 0.1 * Lp$ by the cross bar having a length Lt, wherein a ratio of Lp to Lt is in a range of 0.2 to 5.

8. The elongated structure as claimed in claim 1, wherein the circular wall is provided with at least one first vent opening and at least one second vent opening that are in the axial direction at opposite sides of the at least two doors.

9. The elongated structure as claimed in claim 1, wherein the hollow core is sub-divided into at least two compartments by at least one transverse plate.

10. The elongated structure as claimed in claim 1, wherein the base section has a maximal diameter Db and wherein an extension section of the tubular body part coupled to the base section has a maximal diameter Dp, wherein $Dp <= Db <= 1.3 * Dp$.

11. The elongated structure as claimed in claim 1, wherein the elongated structure decreases in diameter from the base section in the axial direction.

12. The elongated structure as claimed in claim 1, wherein the elongated structure continuously decreases in diameter from the base section in the axial direction.

13. The elongated structure as claimed in claim 1, wherein the elongated structure is a street pole.

14. The elongated structure as claimed in claim 1, wherein the elongated structure is a street light pole and comprises a lamp housing mounted at an end section of the elongated structure.

15. The elongated structure as claimed in claim 1, wherein the cross-bar and/or the stems comprise at least one of a slot, a threaded end, a transverse plate, a threaded opening, a hook, and a rib for mounting the electronic equipment to the H-shaped frame.

* * * * *